US006241422B1

(12) United States Patent
Makowski

(10) Patent No.: US 6,241,422 B1
(45) Date of Patent: Jun. 5, 2001

(54) METHOD OF CONSTRUCTING CAISSONS FOR WAVE GENERATORS

(76) Inventor: Thomas J. Makowski, 10500 Greenlee Rd., Waterford, PA (US) 16441

( * ) Notice: Subject to any disclaimer, the term of this patent is extended or adjusted under 35 U.S.C. 154(b) by 0 days.

(21) Appl. No.: 09/065,785

(22) Filed: Apr. 23, 1998

Related U.S. Application Data

(60) Provisional application No. 60/051,006, filed on Apr. 25, 1997.

(51) Int. Cl.[7] ..... E02B 3/00; A47K 3/10

(52) U.S. Cl. ..... 405/79; 405/52; 52/169.7; 4/491

(58) Field of Search ..... 405/79; 52/169.7, 52/294, 741.12, 741.13, 741.15, 745.12; 4/491, 506

(56) References Cited

U.S. PATENT DOCUMENTS

| | | | | |
|---|---|---|---|---|
| 3,350,724 | * | 11/1967 | Leigh | 4/491 |
| 3,487,599 | * | 1/1970 | Jansen | 52/169.7 |
| 3,629,877 | * | 12/1971 | Schuster | 4/491 |
| 3,638,378 | * | 2/1972 | Russ, Jr. | 52/169.7 |
| 3,930,346 | * | 1/1976 | Blakeway | 52/169.7 |
| 4,179,761 | * | 12/1979 | Corna et al. | 52/169.7 X |
| 4,276,661 | | 7/1981 | Baker . | |
| 4,400,834 | * | 8/1983 | Corna et al. | 4/506 |
| 4,467,483 | | 8/1984 | Bastenhof . | |
| 4,501,100 | * | 2/1985 | Corna et al. | 52/169.7 |
| 4,515,500 | * | 5/1985 | Bastenhof | 405/79 |
| 4,522,535 | * | 6/1985 | Bastenhof | 405/79 |
| 4,550,538 | * | 11/1985 | Blakeway | 52/169.7 |
| 4,558,474 | | 12/1985 | Bastenhof . | |
| 4,616,459 | * | 10/1986 | Shubow | 52/741.15 X |
| 4,692,949 | * | 9/1987 | Dunn | 405/79 X |
| 4,792,260 | | 12/1988 | Sauerbier . | |
| 4,812,077 | | 3/1989 | Raike . | |
| 4,954,014 | | 9/1990 | Sauerbier . | |
| 5,236,280 | | 8/1993 | Lochtefeld . | |
| 5,271,692 | | 12/1993 | Lochtefeld . | |
| 5,535,702 | * | 7/1996 | Idbeis | 405/79 X |

* cited by examiner

*Primary Examiner*—David Bagnell
*Assistant Examiner*—Jong-Suk Lee
(74) *Attorney, Agent, or Firm*—Edward W. Goebel, Jr.; MacDonald, Illig, Jones & Britton LLP

(57) ABSTRACT

A set of caissons for use with wave generators for swimming pools has its vertical walls prefabricated out of stainless steel prior to installation. These vertical walls include a stainless steel end wall at each end of the caissons and a stainless steel back wall extending transverse to the back of the caissons. Partition walls extend to the floor between adjacent caissons and to the ceiling of these caissons as required by the wave generator with which they are used. Stainless steel baffle dividers can also be installed within selected caissons to inhibit the production of waves within individual caissons. Additionally, a stainless steel front wall traverses the front of the set of caissons and extends from the ceiling of the caissons to a selected distance above the floor of the caissons. At least the partition walls and the front walls are prefabricated out of a plurality of sheets of stainless steel which allow spaces there between to enable concrete to be poured between the sheets of stainless steel of each such wall. The bottoms of the stainless steel of all the walls are fastened to the floor of the caissons either by locating the bottoms below the upper floor level where concrete is poured or by connecting them to the concrete after the floor has been poured. After concrete is poured in the spaces to receive concrete between the sheets of stainless steel of the walls, a ceiling is installed over the caissons.

13 Claims, 8 Drawing Sheets

METHOD OF CONSTRUCTING CAISSONS FOR WAVE GENERATORS

This application claims the benefit of U.S. Provisional Application No. 60/051,006 filed Apr. 25, 1997.

BACKGROUND OF THE INVENTION

This invention relates to wave generators for recreation facilities such as swimming pools and water rides, and more particularly to wave generators and related pools and water rides which generate waves through the use of caissons.

Waves are often generated in the water of swimming pools, river water rides and similar recreational facilities through the use of various hydraulic or pneumatic/hydraulic wave generators. Many of these wave generators produce waves through the use of compartments called caissons installed in the water. Generally speaking, each of these caissons has a fluid-tight upper portion and a lower portion which extends beneath the quiescent level of the water in which the waves are to be generated. Each caisson communicates with the swimming pool or water ride in which it is installed through a submerged passage. Some typical wave generators are described and shown in U.S. Pat. No. 4,276,661 issued to Baker on Jul. 7, 1981 and U.S. Pat. No. 4,812,077 issued to Raike on Mar. 14, 1989.

Previously, caissons have been built out of concrete so as to withstand the pressures produced on the water within them which cause waves to be generated. The concrete caissons have been constructed by building forms in which concrete was to be poured and then assembling grids of reinforcement rods or rebars within the forms to hold the concrete in place during use. Typically, where one of the vertical walls of a caisson was one foot thick, grids of rebars had to be set within the forms so that they were about three inches from each of the two vertical sides of the concrete walls.

Constructing these caissons was a labor intensive task which would typically involve the use of eight or ten persons over the course of six or eight weeks of time. The time required to install the caissons is often important to owners of the facilities at which they are being installed. Normally it is desirable to open wave swimming pools or water rides in the middle or later part of May to be ready for the summer season. However, construction normally cannot begin until the end of winter and the end of spring rains which might make construction impracticable. A six to eight week caisson construction schedule can often make it difficult to have the facility completed and fully operational in May.

Additionally, concrete caisson walls have tended to wear and crack as a result of the forces produced while waves are being generated. This has required repeated maintenance and has decreased the normal useful life of the caissons. Furthermore, concrete walls within the caissons are often not as smooth as desirable, adversely affecting the generation of waves.

SUMMARY OF THE INVENTION

In accordance with this invention, a set of caissons is constructed having its vertical walls prefabricated out of stainless steel. There is a side wall at each end of the set of caissons and a stainless steel back wall extending transverse the back of these caissons, with each of these side and back walls extending from the ceiling to the floor of the caissons. The set of caissons includes partition walls extending to the floor between adjacent caissons and to the ceiling of these caissons as required by the wave generator. Stainless steel baffle dividers can also be installed within selected caissons to inhibit the production of waves within individual caissons. Additionally, a stainless steel front wall traverses the front of the set of caissons and extends from the ceiling of the caissons to a selected distance above the floor of the caissons. At least the partition walls and the front wall are prefabricated out of a plurality of sheets of stainless steel which allows spaces therebetween to enable concrete to be poured between the sheets of stainless steel of each such wall. Buttresses can be provided to support the back wall and the sides walls. As will be explained below in accordance with one preferred embodiment of this invention, the bottoms of the stainless steel of all walls which extend to the floor of the caisson can be buried within the concrete floor of the caisson.

The prefabricated stainless steel walls of the caisson and any necessary associated buttresses are received at the location where they are to be installed. They are assembled at that location and can be installed so that the bottoms of the stainless steel of all the walls which extend to the floor of the caissons are located below the upper level of the floor before any concrete is poured for the floor. Concrete is then poured for the floor of the caissons. In accordance with the preferred embodiment of this invention, concrete is also poured to a selected level within those stainless steel walls which extend to the floor and are constructed with spaces between sheets of stainless steel. This causes concrete to set up on both sides of the bottoms of the stainless steel of all of the walls which extend to the floor of the caissons. Concrete can then be poured between the sheets of stainless steel of those walls with spaces to receive concrete to fill these walls. Thereafter, a metal ceiling is installed over the caissons, and concrete is poured to form a slab on the metal ceiling.

The structure of these caissons, which includes prefabricated stainless steel walls having concrete within them, and the method of installing them, all in accordance with this invention, have shortened the time of installation of the caissons from a period of about six to eight weeks using eight or ten persons for construction to a period of about one week using four persons. They have resulted in stainless steel caisson outer walls which are not only more aesthetic, but also wearing better and are more effective in wave generation than previous concrete walled caissons.

This invention does not reside in any one of the individual features of the caissons or individual steps of the method of constructing caissons which are disclosed above and in the Detailed Description of the Preferred Embodiments and claimed below. Rather, this invention is distinguished from prior art by its particular combination of features of the caissons and steps of the methods disclosed. Important features of this invention have been disclosed in the Detailed Description of the Preferred Embodiments as shown and described below to illustrate the best mode contemplated to date for carrying out this invention.

BRIEF DESCRIPTION OF THE DRAWINGS

For a more complete understanding and appreciation of this invention and many of its advantages, reference should be made to the following, detailed description taken in conjunction with the accompanying drawings wherein.

DETAILED DESCRIPTION OF PREFERRED EMBODIMENTS

Figure 1:
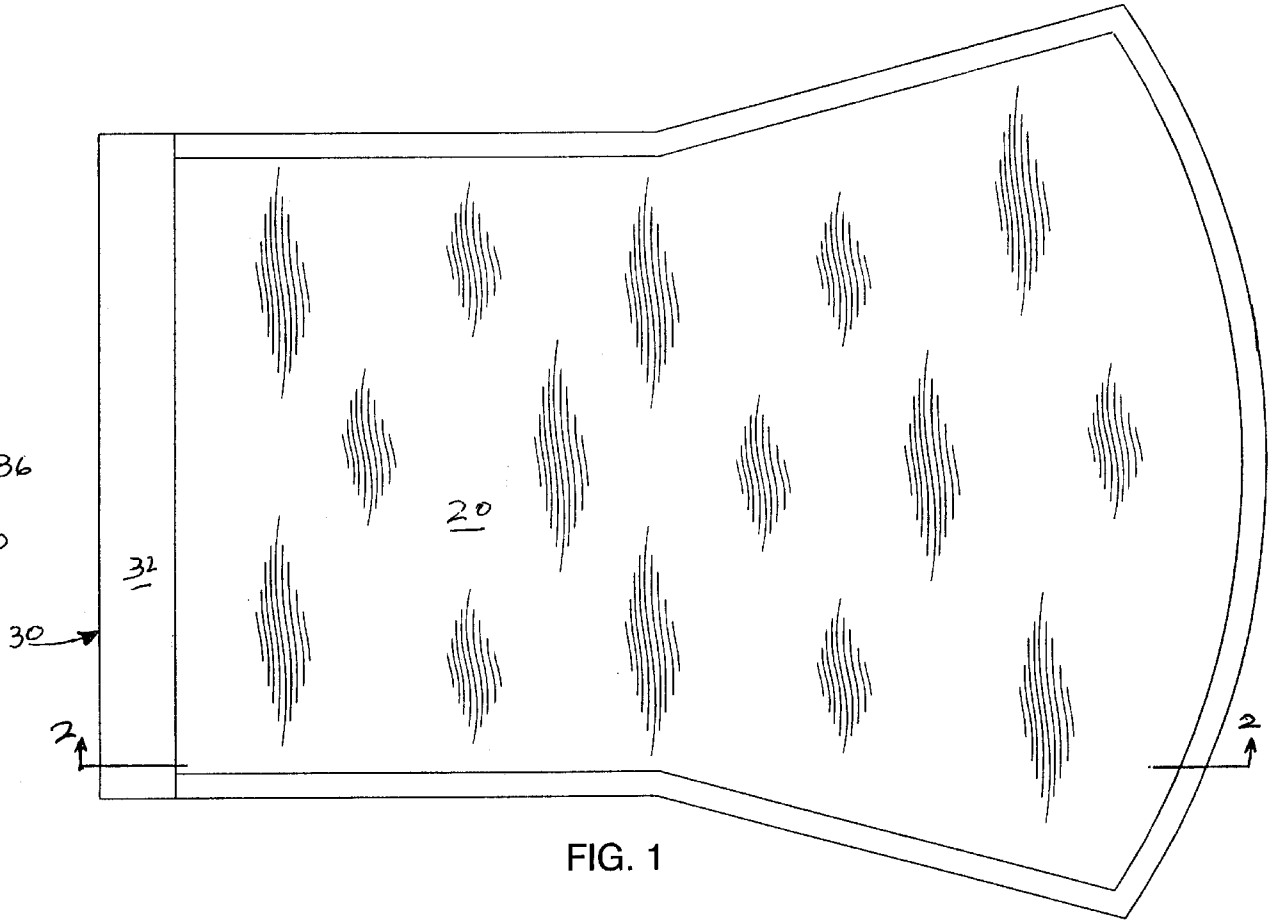
FIG. 1 is a top plan view of a swimming pool having a wave generator with caissons assembled according this invention at its deep end.

Referring to the drawings, identical reference numerals and letters designate the same or corresponding parts throughout the several figures shown in the drawings.

Figure 2:
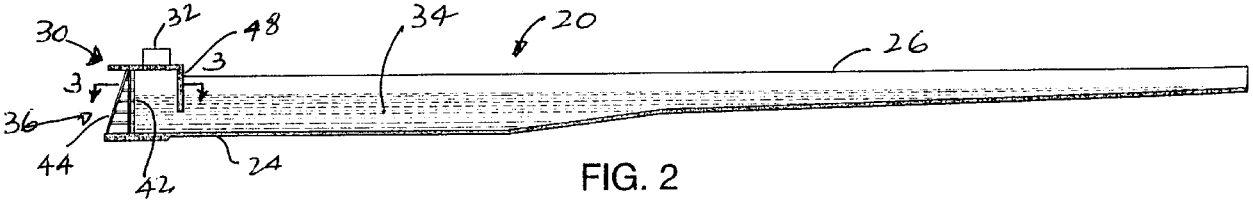
FIG. 2 is a longitudinal cross-section view taken along the line 2—2 in FIG. 1.

Referring now in more detail to the drawings, a swimming pool 20 shown in FIGS. 1 and 2 has a shallow end 22 and a deep end 24, with pool walls 26 and 28 extending between both ends. A wave generator 30 is shown in block form at the deep end 24 of the pool 20. The wave generator 30 generally includes a housing 32 for containing equipment for the generation of waves of the water 34 shown in the swimming pool 20. The wave generator 30 also includes a set of seven caissons 36 within which the waves are generated by the equipment located in the housing 32.

Figure 3:
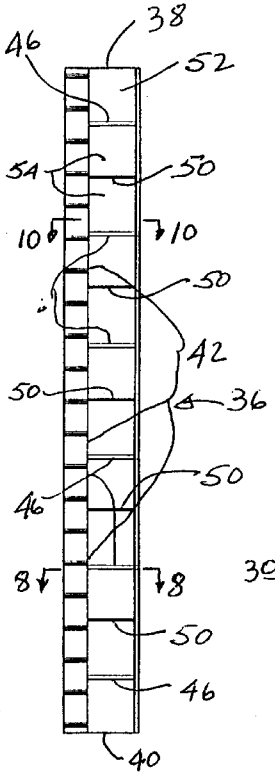
FIG. 3 is a horizontal cross-sectional view of the caissons of this invention taken generally along the line 3—3 in FIG. 2.

The caissons 36 are shown more clearly, schematically, in FIG. 3. The set of caissons includes side walls 38 and 40 at each end and a back wall 42 across the back of all the caissons. A buttress 44 is shown supporting the back wall of the caisson. Partition walls 46 are between adjacent caissons and separate one caisson from another. The caissons also include a front wall 48 which traverses the front of all of the caissons. Five of the caissons shown also include baffles 50 mounted within them so as to dampen wave activity within the caissons themselves. The number of caissons with baffles and the number of baffles, if any, within any of the caissons is a function of the design of the particular wave generator 30 which is selected and is not a feature of this invention.

Figure 4:
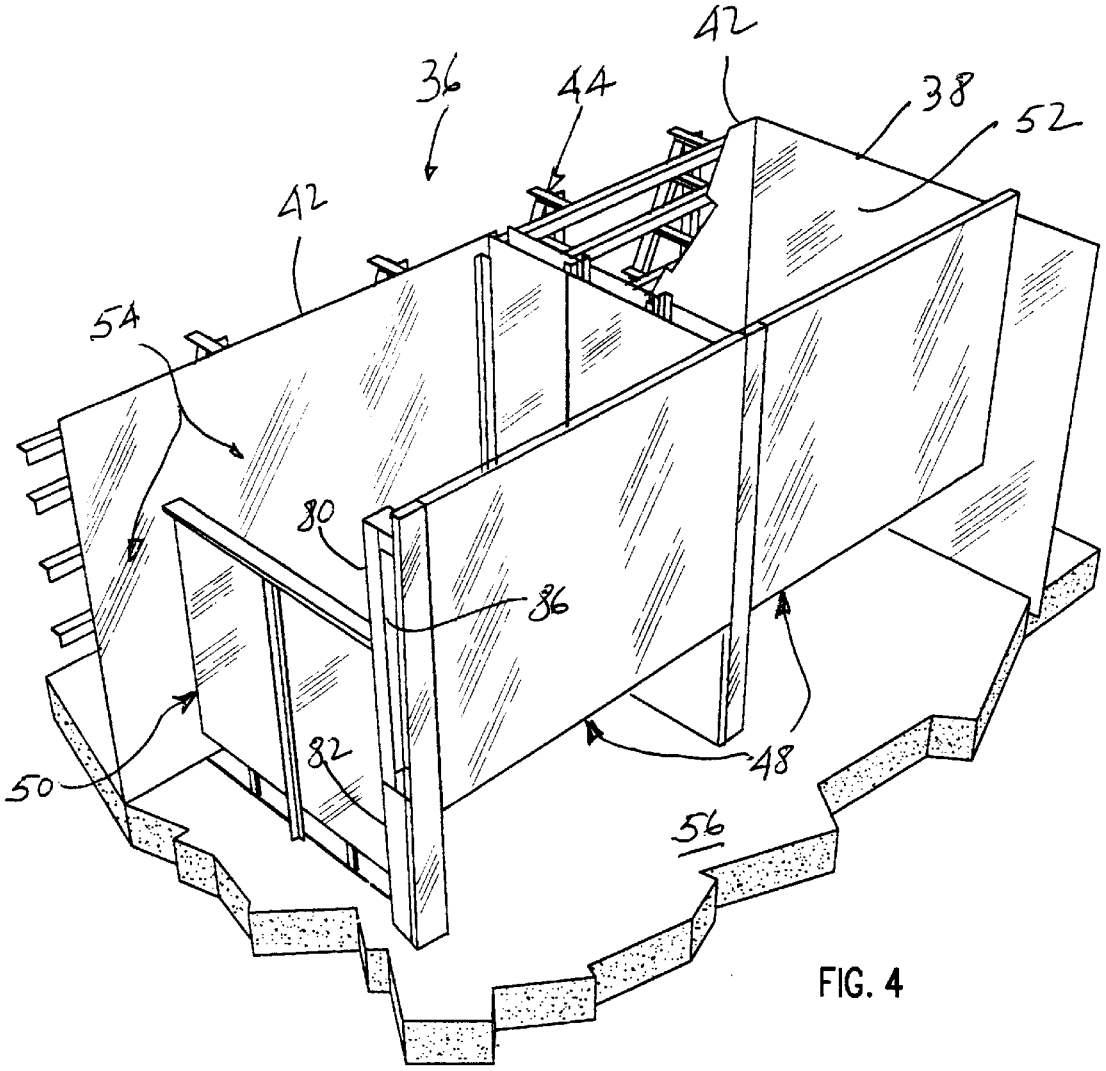
FIG. 4 is an enlarged, perspective view, partially cutaway, of an end caisson and a portion of an adjacent caisson constructed in accordance with this invention.

FIG. 4 shows some of the structure of end caisson 52 and a portion of the structure of caisson 54. The walls of each of these caissons and the baffles within them, along with those of the balance of the caissons 36, are manufactured out of stainless steel. The end caisson 52 is made up of side wall 38, a portion of back wall 42, a portion of front wall 48 and a partition wall 46. It also includes a ceiling and roof structure which are not shown in FIG. 4.

The caisson 54 includes the partition wall 46 between that caisson and the caisson 52, as well as another partition wall (not shown) at the other end of that caisson. The caisson 54 further includes a portion of the back wall 42, a portion of the front wall 48 and the baffle or baffle assembly 50. Generally speaking wave generators use baffles that extend part way toward the ceiling of a caisson, and either part way or all the way to the floor, to dampen waves within the caissons themselves. The caisson 54 also includes a metal ceiling (not shown), which may be made out of corrugated steel, covered with poured concrete. The floor 56 of both the caisson 52 and the caisson 54 is made of concrete.

The balance of the caissons 36 have a similar stainless steel wall and baffle structure. The details of the structure of the walls and baffles used in the preferred embodiment of this invention is more clearly illustrated in FIGS. 5 and 6. In accordance with one aspect of this invention, each of the stainless steel walls which make up the caissons 36 is prefabricated out of stainless steel. The sheets of metal used are 12 gauge stainless steel. The back wall 42 and the side walls 38 and 40 are made up of individual sheets of stainless steel which are tungsten inert gas (TIG) welded at their seams after they are installed to prevent water from leaking from between them. The same TIG welding process is used to weld all of the stainless steel sheets and panels which make up the caissons. In the preferred embodiment the stainless steel sheets of back wall 42 and side walls 38 and 40 are welded to horizontal angle iron supporters 58 which are supported by buttress 44. Both the horizonal supporters 58 and the balance of the buttress can be manufactured out of 3×3×¼ inch steel angle iron.

However, for some applications of this invention the back wall and/or one or both of the side walls may be supported in some other manner, such as through the use of a concrete foundation or a foundation made out of other solid material. This may be advantageous where caissons are installed in an existing swimming pool or water ride. While this does not seem to be necessary for most caissons, the side walls 38 and 40 and the back wall 42 could be prefabricated like the partition walls 46 out of a plurality of sheets of stainless steel to hold concrete within them.

Referring once again to FIGS. 5 and 6, the partition wall 46 is constructed out of sheets of stainless steel 60 which are separated by frame assemblies 62. The frame assemblies 62 can be made of 2×2×¼ inch angle iron strips fastened together by similar angle iron pieces 63. In the preferred embodiment of this invention, one of the strips of each frame assembly was made of stainless steel and the other of carbon steel. The stainless steel strip of one frame assembly 62 was attached to one of the sheets 60, while the stainless steel strip of the other frame assembly 62 was attached to the other sheet 60. The partition wall also includes a face panel 64 which is attached to the front end of the sheets 60 to become part of the front wall 48. A stainless steel angle iron strip 66 is welded to the other end of each of the sheets 60 to aid in connecting them to the stainless steel sheets of the back wall 42. Supports 104 (see FIG. 5) are inserted beneath the extended ends of the partition walls 46 to keep them from sagging.

The baffle assembly 50 comprises one sheet of twelve gauge stainless steel or a plurality of sheets of stainless steel 68 welded together. The stainless steel sheets 68 are supported by three stainless steel angle iron strips 70, with two mounted on one side and one mounted on the other side of sheets 68. All three strips 70 are welded to another stainless steel strip of angle iron 72. A stainless steel cap 74 covers the top of the sheet 68. The ends of the sheet 68 can be bent at right angles to enable it to be more readily welded to the back wall 42 and a baffle column 76. The baffle column 76 is made up of a stainless steel face panel 78, an upper column member 80 and a lower column member 82, along with a column cap 84 at the top of the column. The upper column member 80 is narrower than the lower column member 82 so as to form a slot 86 in the baffle column. The slot 86 is parallel with a slot 88 formed within the partition wall 46. Supports 104 are inserted beneath the baffle column 76 to keep the baffle assembly 76 from sagging.

Figure 5:
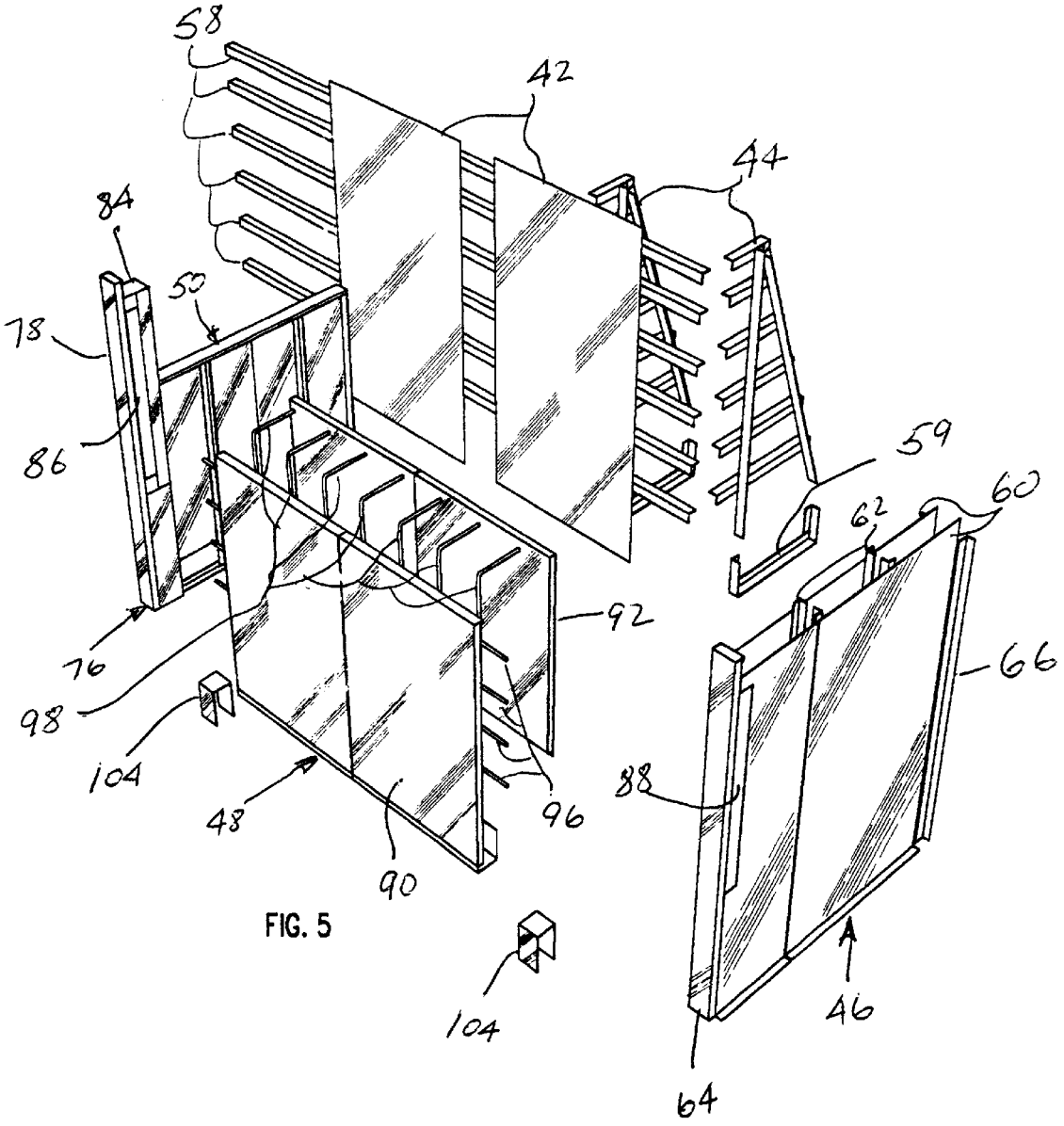
FIG. 5 is an exploded view generally showing the structure of the stainless steel walls and buttresses comprising the partial caisson shown in FIG. 4.
Figure 6:
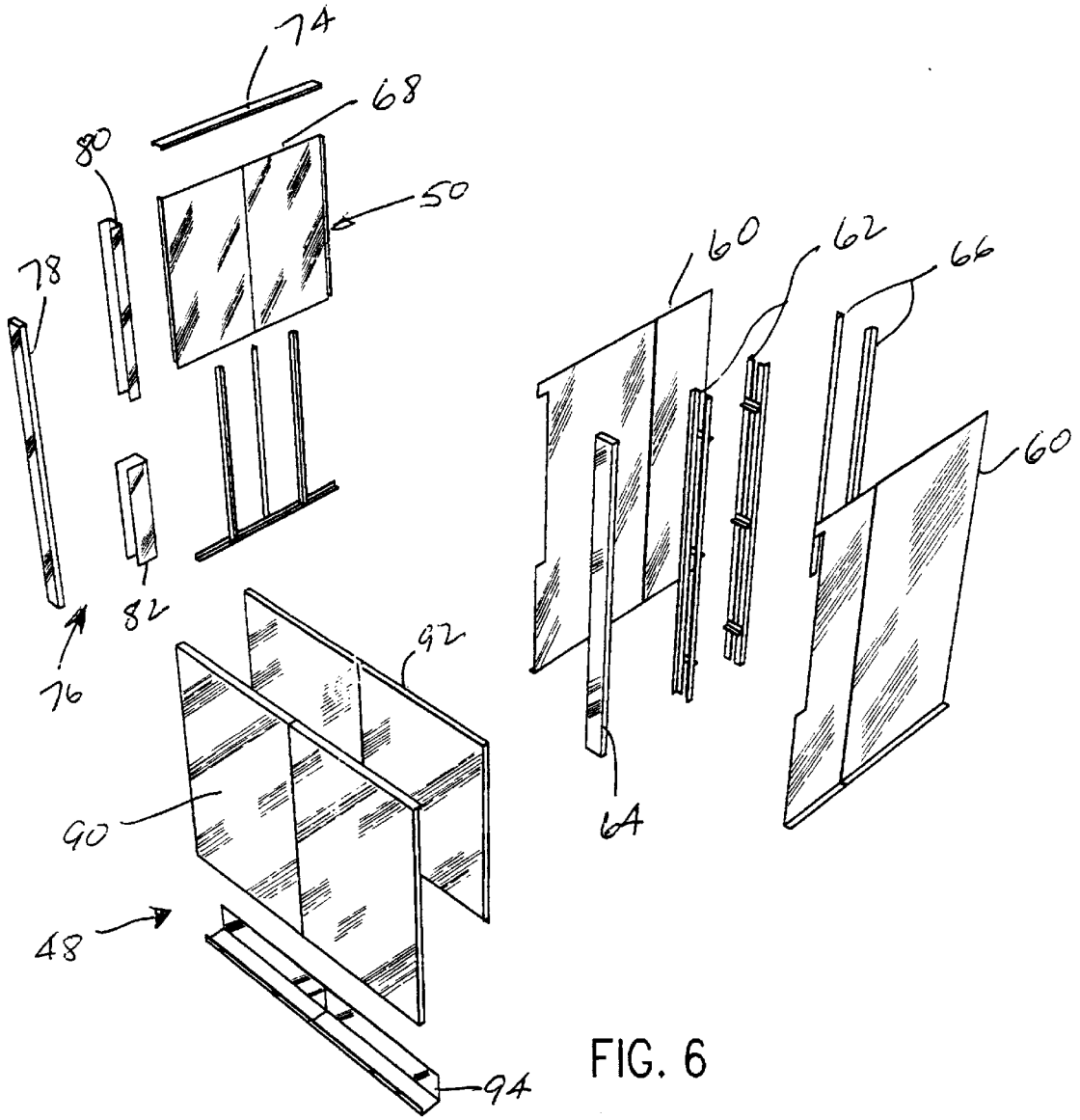
FIG. 6 is an exploded view showing in more detail the structure of the stainless steel partition wall, front wall and baffle assembly shown in FIG. 5.

The front wall 48 comprises a front panel 90, a rear panel 92 and a bottom member 94 on which these panels are mounted. As shown in FIG. 5, a series of rebars should be installed within each front panel and through the slots 86 of each baffle column which is included within the front wall 48 and the slots 88 of each partition wall which is included within the front wall 48. The rebars 96 tie the front wall together when concrete is poured within the various members of the front wall and help support the concrete roof which will be installed on the caissons. A series of rebars 98, each bent at a right angle, are attached to the highest of the rebars 96 and should be attached to rebars used for the concrete roof (not shown in FIG. 5) so as to tie the front wall to the concrete roof.

The prefabrication of the partition walls 46 and the baffle assemblies 50 should include preassembly before they are delivered to the location where the caissons are to be installed so as to shorten the time for installation. The rear panel 92 of the front wall 48 can be left off that assembly when the front walls are delivered and then welded in place after rebars 96 and 98 are installed.

Figure 7:
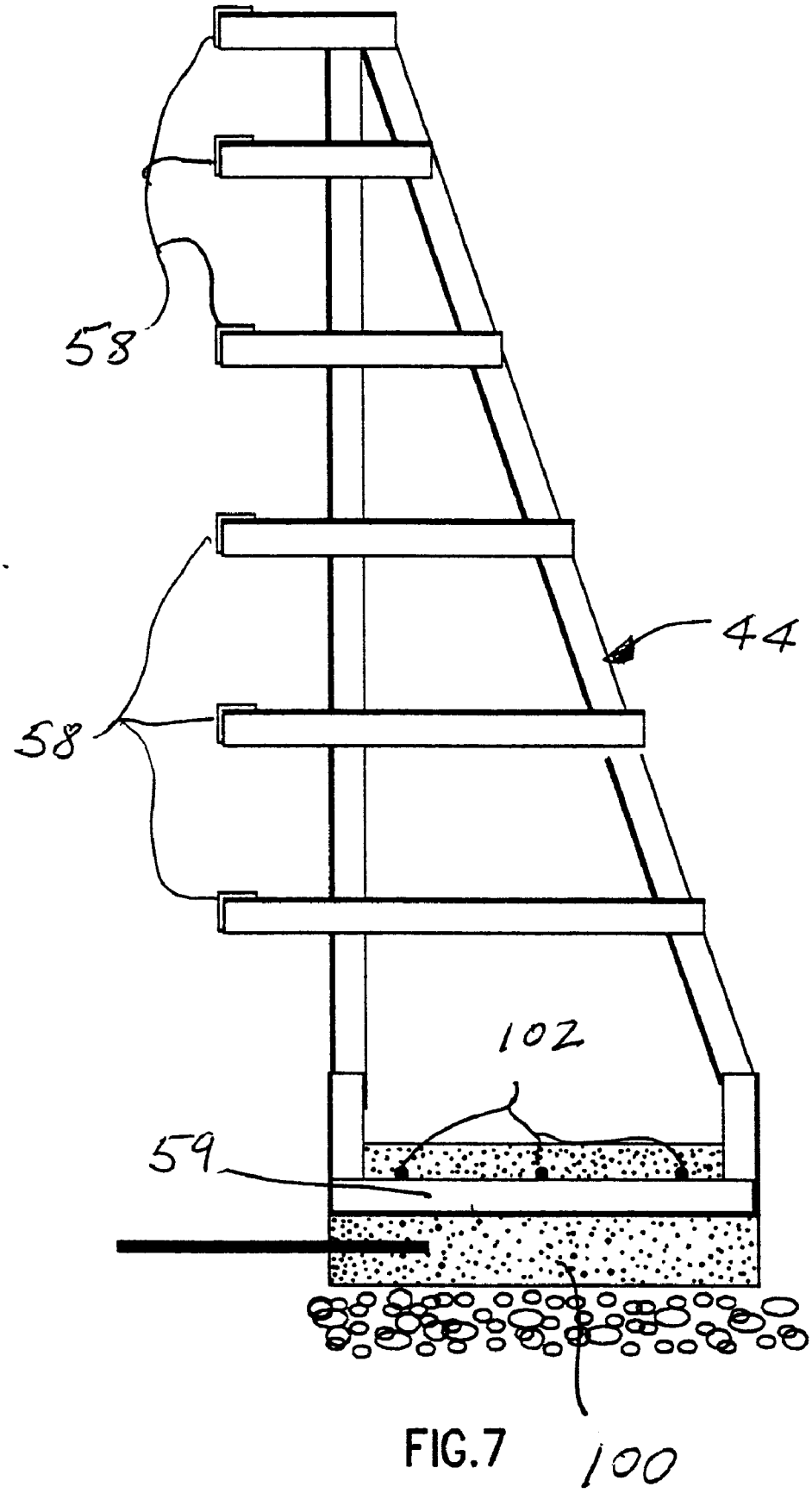
FIG. 7 is a side view, partially cut-away, of the footer, footer bracket and buttress assembly used to support the back and side walls of the caisson.

In accordance with the method of constructing a set of caissons in accordance with this invention, the prefabricated and assembled stainless steel caisson walls, baffles and any supporting buttresses required should be shipped to the site where the caissons are to be installed and received by the construction crew at that site. In accordance with a preferred embodiment of this invention, before the caisson walls and any pool walls are installed, including supporting buttresses that may be required, the area for the pool is properly excavated and a concrete footer is poured. Referring to FIG. 7, a concrete footer 100 can be poured at about the width of footer brackets 59, or any other width or shape desirable. In the preferred embodiment, the width of the footer brackets was 3 feet, and the footer brackets were made of 3×3×¼ inch angle iron to support buttress members about eight feet tall. The footer brackets were installed about 4 feet apart on the concrete footers, although the distance may vary for any installation, and rebars 102 were placed on the footer brackets. Concrete was then poured about the footer brackets and the rebars. After the concrete dries, buttresses 44 are welded onto footer brackets 59, and horizontal supporters 58 are welded onto the buttress 44. The footers and buttress are assembled on both the back wall and the side walls of the caissons. They can also be assembled along the sides of any swimming pool or other facility for which the stainless steel walls are being supported by a buttress.

At this point in the construction process the rebars 96 and 98 can be installed within the front wall 48 by welding them to the face panels 62 and 78 and/or the front panel 90. The rear panel 92 is then welded in place to complete the assembly of the front wall 48.

Figure 8:
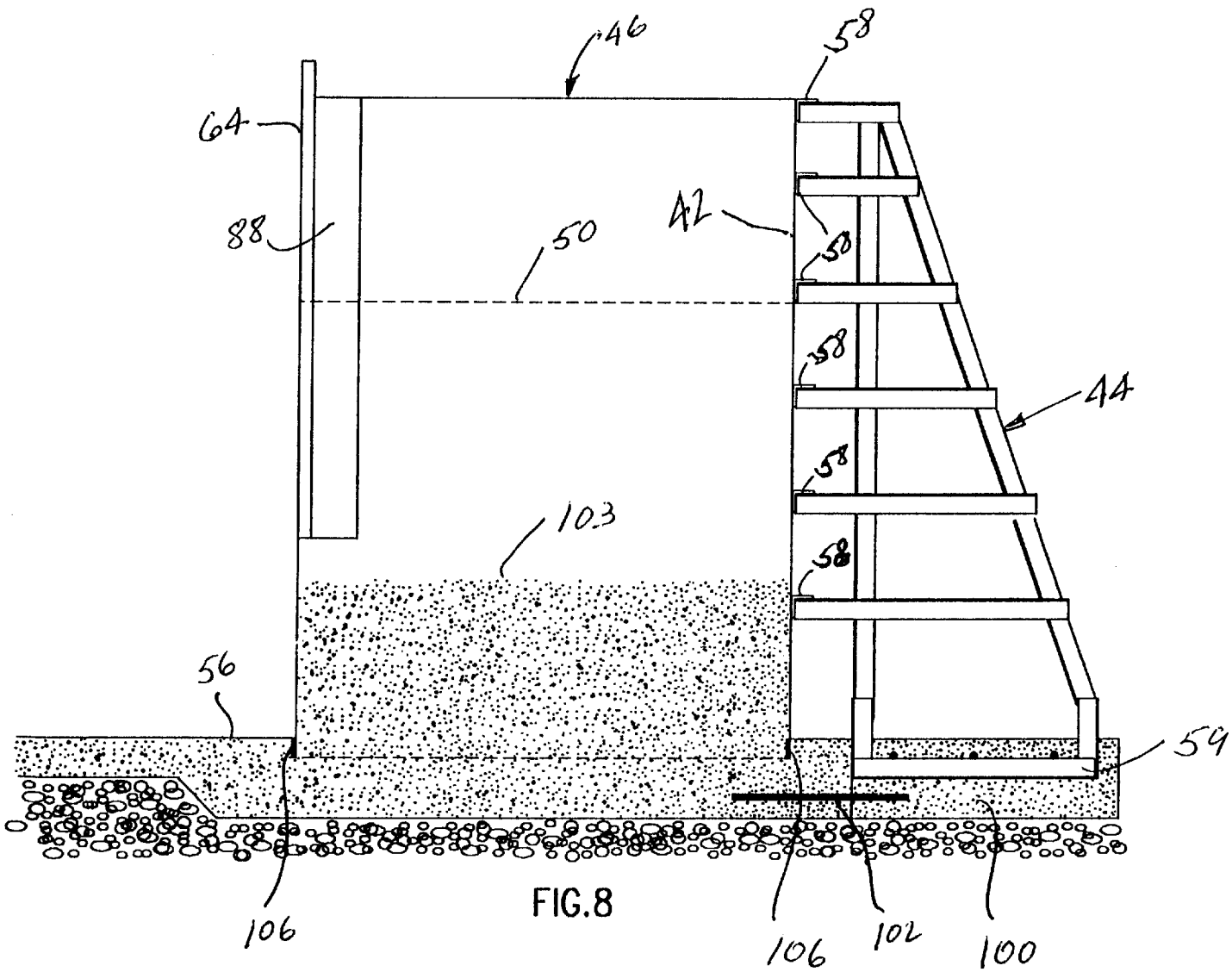
FIG. 8 is a side view, partially cut-away, taken along the line 8—8 in FIG. 1 showing the partition wall and floor of the caisson during installation, before the roof has been added.

In accordance with the preferred embodiment of this invention, the walls which extend to the floor of the caissons are attached to the concrete floor of the caissons by in effect burying them in the concrete of the floor. The stainless steel sheets of each of the walls of the caisson which extend to the floor of the caisson, such as the partition wall 46 shown in FIG. 8, are located below the floor level before any concrete is poured on the floor. A water stop compound 106, such as Duraseal Swelling Paste two part caulking compound sold by BBZ, Incorporated of Southington, Conn., is applied to the bottom of the stainless steel walls to prevent water from deteriorating this area. The bottoms of the stainless steel walls can extend about three inches into the concrete. As shown in FIG. 7, and again in FIG. 8, holes can be drilled into the footer 100 and number four rebars 102 fastened in these holes using epoxy. These rebars 102 tie the footer 100 into the concrete floor 56.

The next step in building the caissons is to pour the concrete floor. Typically, the concrete floor is about one foot thick poured over gravel so as to withstand the pressure produced when generating waves. The bottoms of the stainless steel walls will be embedded in the concrete. Concrete is also poured to a selected level within stainless steel walls extending to the floor, such as the partition walls 46. A cut-away of a partition wall 46 shown as it would be at this point in the construction process is shown in FIG. 8. The concrete is poured within that wall to a level 103 of about 18 inches above the top of the floor 56. Concrete is also poured in the baffle columns 76 so as to cause their stainless steel walls to be embedded in the concrete. This method of attaching the stainless steel walls of the caissons 36 to the caisson floor 56 secures them most effectively so as to withstand the pressures produced within the caissons. However, other methods may be used to secure the stainless steel walls to the concrete floor 56, such as by bolting them to fasteners embedded in the concrete or drilling holes in the concrete and installing fasteners attached to the stainless steel walls.

Figure 9:
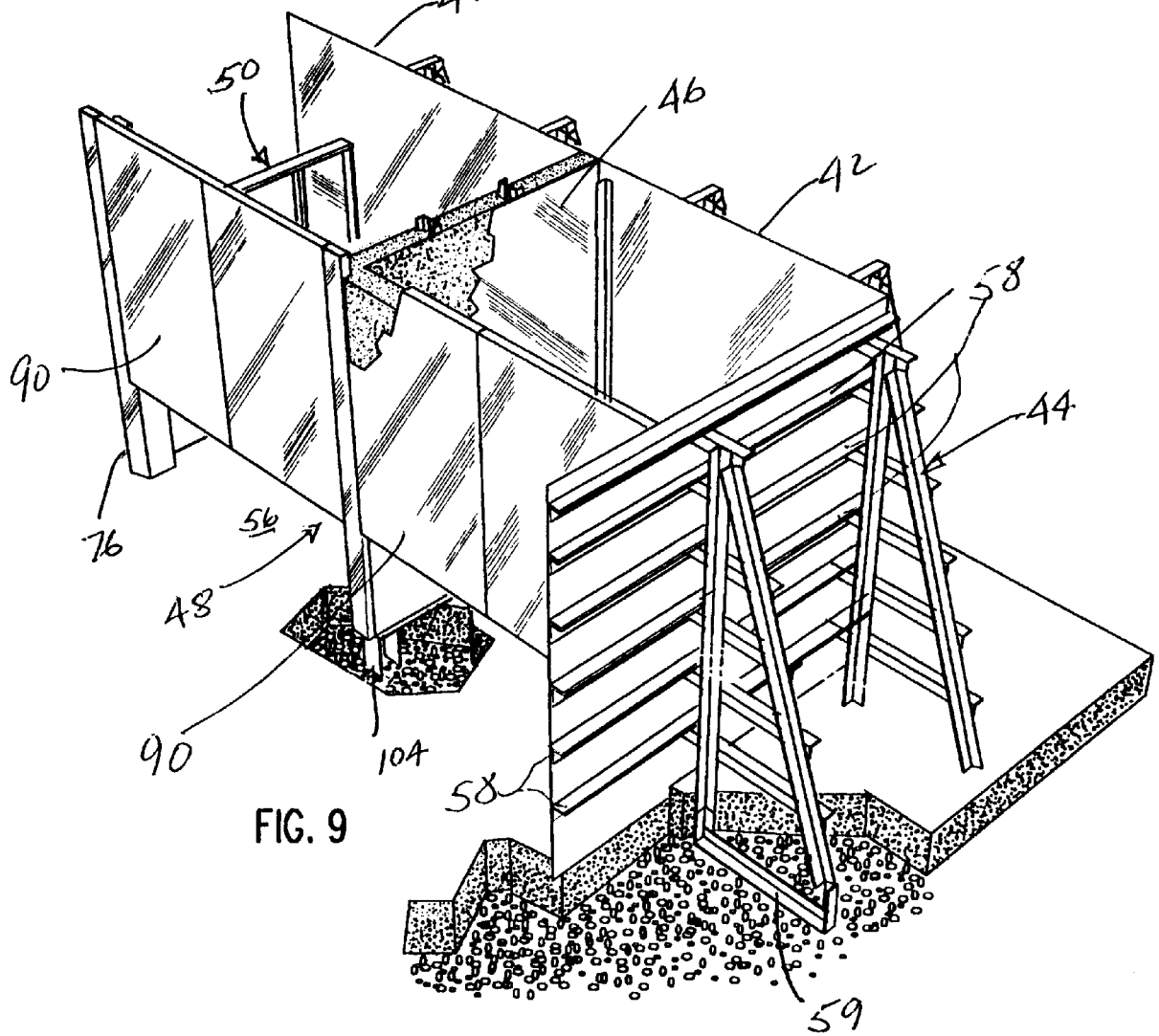
FIG. 9 is a partially cut-away, perspective view taken from one side of a caisson of this invention taken while it is being constructed.

After the stainless steel walls of the caissons 36 have been securely fastened to the caisson floor 56, concrete is poured between the sheets of stainless steel of those walls which have spaces to contain the concrete. This includes not only the partition walls 46 and baffle columns 76, but also the front wall 48. The cut-aways in the partition wall 46 and the front wall 48 in FIG. 9 show how concrete has filled the spaces between the stainless steel sheets of these walls to produce a secure and stable caisson structure. The cut-away at the bottom of the partition wall 46 in FIG. 9 shows a support 104 beneath the outer end of the partition wall 46. This support 104 is also buried in concrete when the caisson floor 56 is poured.

Figure 10:
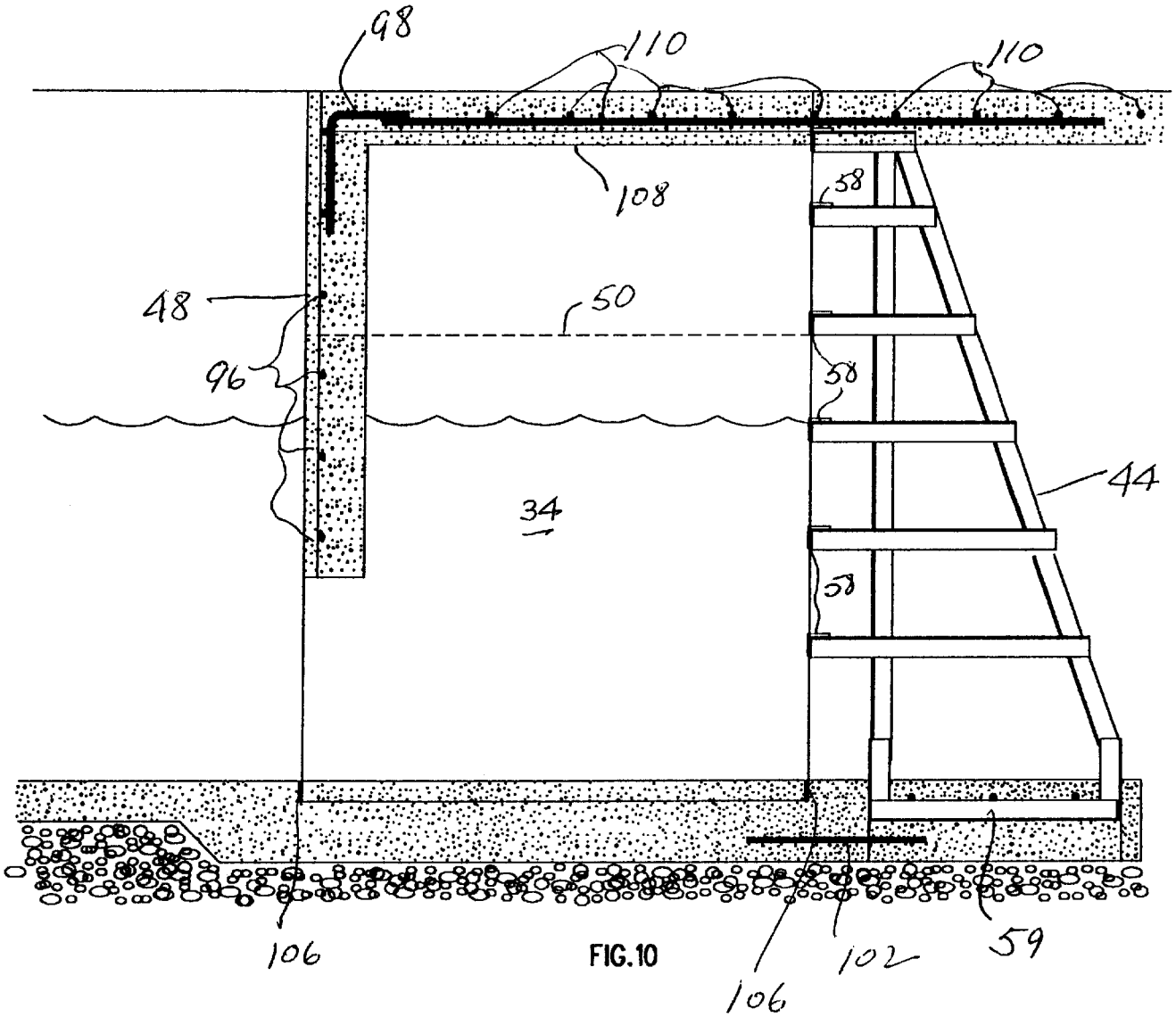
FIG. 10 is a side view of the this invention taking along a line 10—10 in FIG. 3, showing the front walls, roof, buttress and floor the caisson after construction is completed.

The final steps in the construction of the caissons 36 are the installation of a ceiling over the caisson and the pouring of a concrete slab over that ceiling. Referring to FIG. 10, a ceiling 108 can be made of corrugated steel. A grid of rebars 110 can be placed upon the roof 108 and fastened to the rebar 98 in the front panel 48. Thereafter, a concrete slab is poured over the ceiling 108 to form the roof of the caissons 36. Tubing and other apparatus to create the pressures within the caissons can be installed within the caisson chambers, as is known to those skilled in the art.

The caissons and method of construction of caissons of this invention can also be applied to facilities other than swimming pools, such as river rides. In one typical installation for a river ride, a set of caissons would be installed in each side of a section of the river ride. These caissons may be interconnected by tubing so as to produce the air pressure required to generate waves. In an installation such as this, the caissons would be smaller than for a swimming pool and would most likely be installed against an abutment, and the buttresses may not be necessary to support the back and side walls.

Those skilled in the art will recognize that this invention has been explained with respect to the details, arrangements of components and steps of certain specific embodiments which have been described and illustrated to explain the nature of this invention. Many modifications can be made to this invention by those skilled in the art without departing from its spirit and scope. Thus, the appended claims are intended to be interpreted to cover such equivalent caissons and methods of constructing caissons and related tools which do not depart from the spirit and scope of this invention.

What is claimed is:

1. A method of constructing one or more caissons used for generating waves in a pool of water, each caisson having a floor and a ceiling, comprising the acts of:

a) receiving walls of caissons which are prefabricated out of stainless steel, the caissons having a side wall at each end extending from the ceiling to the floor, a back wall extending transverse the back of the caissons from the ceiling to the floor between the two sidewalls, partition walls extending to the floor between adjacent caissons and a front wall transverse the front of the caissons extending from the ceiling to a selected distance above the floor of the caissons, with at least the front wall and the partition walls prefabricated out of a plurality of sheets of stainless steel which allow spaces there between to enable concrete to be poured between the sheets of stainless steel of each such wall;

b) assembling the prefabricated stainless steel walls at the location of the pool where the walls are to be installed so that the bottoms of the stainless steel of all walls which extend to the floor of the caissons are located below the upper level of the floor before any concrete is poured for the floor;

c) pouring concrete for the floor of the caissons and pouring concrete to a selected level within those stainless steel walls extending to the floor which are constructed with spaces between sheets of stainless steel so as to cause concrete to be on both sides of the bottoms of the stainless steel of all walls which extend to the floor of the caissons;

d) pouring concrete once again between the sheets of stainless steel of those walls with spaces there between; and e) installing a metal ceiling over the caissons and pouring concrete on the metal ceiling.

2. The method according to claim 1 in which the sidewalls and the back wall are prefabricated out of stainless steel, and the method includes constructing a buttress to support the back wall.

3. The method according to claim 2 which includes installing rebars in the front wall before concrete is poured in the spaces between sheets of stainless steel.

4. A method of constructing a plurality of caissons used for generating waves in a pool of water, each caisson having a floor, a ceiling, a back wall extending transverse the back of each of the caissons from the ceiling to the floor of each caisson, a front wall extending transverse the front of said caissons from the ceiling to a selected distance above the floor of the caissons, each caisson having at least one partition wall extending from the ceiling to the floor, comprising:

a) having selected walls of the caissons prefabricated out of stainless steel, with at least the front wall and the at least one partition wall prefabricated out of a plurality of sheets of stainless steel which allow spaces there between to enable concrete to be poured between the sheets of stainless steel;

b) receiving the walls of the caissons which are prefabricated out of stainless steel;

c) assembling the walls prefabricated out of stainless steel at the location of the pool where the walls are to be installed so that bottoms of the stainless steel walls which extend to the floor of the caissons can be secured to the floor;

d) pouring concrete within the spaces between sheets of stainless steel; and e) constructing a ceiling across the caissons out of materials including concrete.

5. The method according to claim 4 which includes having the sidewalls and the back wall of the caissons prefabricated out of stainless steel.

6. The method according to claim 4 which includes having the stainless steel walls prefabricated so that the bottoms of these walls which extend to the floor can be secured to the floor with fasteners, and using the fasteners to secure to the floor the bottoms of stainless steel walls which extend to the floor.

7. The method according to claim 4 which includes installing stainless steel walls which extend to the floor so that the bottoms of the stainless steel are located below the upper level of the floor.

8. The method according to claim 7 which includes pouring concrete for the floor of the caissons and pouring concrete to a selected level within those stainless steel walls extending to the floor which are constructed with spaces between sheets of stainless steel so as to cause concrete to be on both sides of the bottoms of the stainless steel of the walls which are below the level of to the floor of the caissons to secure the bottoms to the floor.

9. The method according to claim 8 which includes installing a metal ceiling over the caissons and pouring concrete on the metal ceiling.

10. The method according to claim 8 which includes having the back wall and the sidewalls prefabricated out of stainless steel.

11. The method according to claim 4 which includes installing a stainless steel baffle within at least one of the caissons.

12. The method according to claim 4 which includes having the back wall and the sidewalls prefabricated out of stainless steel and supporting the back wall with a buttress.

13. The method according to claim 4 in which the plurality of caissons includes a first set of caissons and a second set of caissons, and the method includes assembling the first set of caissons on one side of a portion of the pool and assembling the second set of caissons on a second side of the portion of the pool.

* * * * *